United States Patent [19]

Murakami

[11] Patent Number: 4,597,049

[45] Date of Patent: Jun. 24, 1986

[54] ACCELERATOR CONTROL SYSTEM FOR AUTOMOTIVE VEHICLE

[75] Inventor: Terukiyo Murakami, Yokosuka, Japan

[73] Assignee: Nissan Motor Company, Limited, Yokohama, Japan

[21] Appl. No.: 564,682

[22] Filed: Dec. 23, 1983

[30] Foreign Application Priority Data

| | | | |
|---|---|---|---|
| Dec. 28, 1982 | [JP] | Japan | 57-230433 |
| Dec. 28, 1982 | [JP] | Japan | 57-230434 |
| Dec. 28, 1982 | [JP] | Japan | 57-202251[U] |
| Jan. 7, 1983 | [JP] | Japan | 58-978 |

[51] Int. Cl.[4] ..... F02D 9/08

[52] U.S. Cl. ..... 364/431.07; 364/426; 123/350; 123/352

[58] Field of Search ..... 364/431.05, 431.07, 364/431.12, 426; 123/349, 350, 351, 352, 361, 395, 399

[56] References Cited

U.S. PATENT DOCUMENTS

| | | | |
|---|---|---|---|
| 3,893,537 | 7/1975 | Sakakibara | 123/352 |
| 3,983,851 | 10/1976 | Hoshi | 364/431.07 |
| 4,113,046 | 9/1978 | Arpino | 123/350 |
| 4,188,926 | 2/1980 | Fleischer . | |
| 4,279,228 | 7/1981 | Mann . | |
| 4,301,883 | 11/1981 | Collonia . | |
| 4,305,359 | 12/1981 | Mann et al. . | |
| 4,359,028 | 11/1982 | Fiala | 123/350 |
| 4,377,995 | 3/1983 | Fiala . | |
| 4,380,799 | 4/1983 | Allard et al. . | |
| 4,419,729 | 12/1983 | Krieder | 364/426 |
| 4,419,973 | 12/1983 | Collonia . | |
| 4,453,516 | 6/1984 | Filsinger | 123/352 |
| 4,470,396 | 9/1984 | Hasumi et al. . | |
| 4,495,454 | 1/1985 | Collonia | 364/431.05 |

FOREIGN PATENT DOCUMENTS

| | | |
|---|---|---|
| 0060326 | 10/1981 | European Pat. Off. . |
| 2436982 | 2/1976 | Fed. Rep. of Germany . |
| 3028601 | 8/1981 | Fed. Rep. of Germany . |
| 2343622 | 10/1977 | France . |
| 2356007 | 1/1978 | France . |
| 2385553 | 10/1978 | France . |
| 2453048 | 10/1980 | France . |
| 48-96921 | 12/1973 | Japan . |
| 51-138235 | 11/1976 | Japan . |
| 55-123327 | 9/1980 | Japan . |
| 56-132428 | 10/1981 | Japan . |
| 57-44750 | 3/1982 | Japan . |
| 2068456 | 8/1981 | United Kingdom . |
| 1603921 | 12/1981 | United Kingdom . |

OTHER PUBLICATIONS

"Automotive Engineering", vol. 90, Jun. 1982.
"Motortechnische Zeitschrift", vol. 42, Dec. 1981.

*Primary Examiner*—Parshotam S. Lall
*Attorney, Agent, or Firm*—Schwartz, Jeffery, Schwaab, Mack, Blumenthal & Evans

[57] ABSTRACT

When a driver repeatedly depresses an accelerator pedal only slightly to drive his vehicle small distances forward, as he might on a busy road, the ordinary accelerator pedal control characteristics are automatically changed to fine control characteristics such that opening rate of the throttle valve increases relatively gently with increasing accelerator pedal stroke. The control characteristics are changed from the ordinary ones to the fine ones, when both of detected accelerator pedal stroke and stroke speed do not exceed predetermined reference values within a predetermined time period after the accelerator pedal has been depressed.

28 Claims, 14 Drawing Figures

ACCEL SWITCH
7
ACCEL STROKE SENSOR
6
10
ACCEL DEPRESSION TIMING DETECTOR
ADTS
ASS
DASS
DIFFERENTIATOR
9
8
A/D
MICROCOMPUTER
1
2
D/A
SERVOMOTOR DRIVER
5
3
SERVOMOTOR
4
P

ACCELERATOR CONTROL SYSTEM FOR AUTOMOTIVE VEHICLE

BACKGROUND OF THE INVENTION

1. Field of the Invention

The present invention relates to an accelerator control system for an automotive vehicle and more specifically to an accelerator control system in which appropriate accelerator control characteristics are automatically selected according to vehicle travelling conditions or accelerator pedal depression conditions.

2. Description of the Prior Art

In automotive vehicles, an accelerator pedal is mechanically connected or linked directly to a throttle valve through a wire or a link mechanism, so that the opening rate of the throttle valve can be directly adjusted as the accelerator pedal is depressed by the driver.

However, in the prior-art mechanical accelerator device, the accelerator control characteristics representative of the relationship between throttle valve opening rate and accelerator pedal stroke are fixedly determined in dependence upon the mechanical structure of the accelerator device such as the throttle valve actuating device. In other words, these accelerator pedal control characteristics between accelerator pedal stroke and throttle valve opening rate are fixedly, unselectably or unadjustably predetermined according to the types of throttle devices.

Therefore, some types of throttle devices are provided with characteristics such that throttle valve opening rate increases relatively sharply with increasing accelerator pedal stroke. These control characteristics are appropriate when a vehicle is travelling at a relatively high speed on a highway but not appropriate when the vehicle is travelling at a relatively low speed on a busy street. In more detail, when a vehicle is travelling at a high speed on a highway, these control characteristics are suitable because the driver sometimes needs to quickly accelerate the vehicle in order to avert an accident. However, when the vehicle is travelling at a low speed on a busy street, these control characteristics are not suitable because the driver often needs to repeatedly drive the vehicle only a short distance forward and it is rather difficult for the driver to repeatedly depress the accelerator pedal finely and skillfully.

In contrast with this, some other types of throttle devices are provided with characteristics such that throttle valve opening rate increases relatively gently with increasing accelerator pedal stroke. These control characteristics are appropriate when a vehicle is travelling at a relatively low speed on a busy street but not appropriate when the vehicle is travelling at a relatively high speed on a highway. This is because the driver must depress the accelerator pedal deeply or excessively when accelerating the vehicle quickly on a highway to avert an accident.

In summary, in the prior-art throttle devices for automotive-vehicles, there exists a problem in that it is impossible to obtain appropriate accelerator control characteristics representative of the relationship between throttle valve opening rate and accelerator pedal stroke according to vehicle travelling conditions.

SUMMARY OF THE INVENTION

With these problems in mind, therefore, it is the primary object of the present invention to provide an accelerator control system and an accelerator control method for an automotive vehicle such that once the driver depresses the accelerator pedal finely to drive the vehicle a short distance forward, the ordinary accelerator control characteristics on which throttle valve opening rate increases relatively sharply with increasing accelerator pedal stroke are automatically changed to the fine accelerator control characteristics on which throttle valve opening rate increases relatively gently with increasing accelerator pedal stroke. The state where the driver depresses the accelerator pedal finely is determined on the basis of detecting both of accelerator pedal stroke and accelerator pedal stroke speed. Further, when the driver depresses the pedal ordinarily, the control characteristics are of course returned to the ordinary control characteristics automatically.

To achieve the above-mentioned object, the accelerator control system for an automotive vehicle according to the present invention comprises means for detecting accelerator pedal depression timing and for outputting an ADTS signal indicative of the detected timing; means for detecting the stroke of the accelerator pedal and for outputting an ASS signal indicative of the detected stroke; means for detecting the stroke speed of the accelerator pedal and for outputting a DASS signal indicative of the detected stroke speed; a microcomputer means, responsive to the signal ADTS outputted from the accelerating pedal depression timing detecting means, for comparing the voltage level of the detected signal ASS indicative of the accelerator pedal stroke with a first reference stroke voltage level ASS1 and the voltage level of the detected signal DASS indicative of the accelerator pedal stroke speed with a first reference stroke speed voltage level DASS1 within predetermined time period To, after said ADTS signal is output, for outputting a first command signal when either or both of the voltage levels of the detected signals ASS and DASS exceed the first reference voltage levels ASS1 and DASS1 respectively and a second command signal when neither of the voltage levels of the detected signals ASS and DASS do not exceeds the first reference voltage levels ASS1 and DASS1 respectively, for storing first ordinary control characteristics such that opening rate of the throttle valve increases relatively sharply with increasing accelerator pedal stroke and second fine control characteristics such that opening rate of the throttle valve increases relatively gently with increasing accelerator pedal stroke, for selecting the first ordinary control characteristics in response to the first command signal generated when either or both of the voltage levels of the signals ASS and DASS exceed the first reference voltage levels ASS1 and DASS1 respectively and the second fine control characteristics in response to the second command signal generated when neither of the voltage levels of the signals exceeds the first reference voltage levels respectively, and for determining target throttle valve opening rates corresponding to the detected accelerator pedal strokes ASS in accordance with the selected control characteristics and outputting target throttle valve opening rate control signals corresponding thereto; and means for controlling the opening rates of the throttle valve on the basis of the target throttle valve opening rate control signals so that the actual opening rate matches the target rate.

Further, to achieve the above-mentioned object, the method of controlling an accelerator for an automotive according to the present invention comprises the following steps of: (a) detecting an accelerator pedal depression timing, (b) measuring a predetermined time period To in response to a signal ADTS indicative of accelerator pedal depression timing, (c) detecting accelerator pedal strokes, (d) detecting accelerator pedal stroke speed, (e) storing first ordinary control characteristics and second fine control characteristics, (f) comparing the voltage level of the detected accelerator pedal stroke ASS with a first reference stroke voltage level ASS1 and the voltage level of the detected accelerator pedal stroke speed DASS with a first reference stroke speed voltage level DASS1 only within the predetermined time period To, (g) when either or both of the voltage levels of the detected stroke ASS and stroke speed DASS exceed the first reference voltage levels ASS1 and DASS1 respectively, stopping the time measuring operation and selecting the first ordinary control characteristics; (h) when neither of the voltage levels of the detected stroke ASS and stroke speed DASS exceeds the first reference voltage levels ASS1 and DASS1 respectively, checking whether the predetermined time period To has elapsed or not; (i) when the time period To has elapsed, stopping the time measuring operation and selecting the second fine control characteristics; (j) when the time period To has not elapsed, selecting the first ordinary control characteristics, (k) determining target throttle valve opening rates corresponding to the detected accelerator pedal strokes in accordance with the selected control characteristics; and (l) controlling the opening rates of the throttle valve on the basis of the target throttle valve opening rates so that the actual opening rate matches the target rate.

BRIEF DESCRIPTION OF THE DRAWINGS

The features and advantages of the accelerator control system and method for an automotive vehicle according to the present invention over the prior-art accelerator control systems will be more clearly appreciated from the following description of the preferred embodiments of the invention taken in conjunction with the accompanying drawings in which like reference numerals designate the same or similar elements or sections throughout the figures thereof and in which.

DETAILED DESCRIPTION OF THE PREFERRED EMBODIMENTS

In view of the above description, reference is now made to a first embodiment of the accelerator control system and method for an automotive vehicle according to the present invention.

Figure 1:
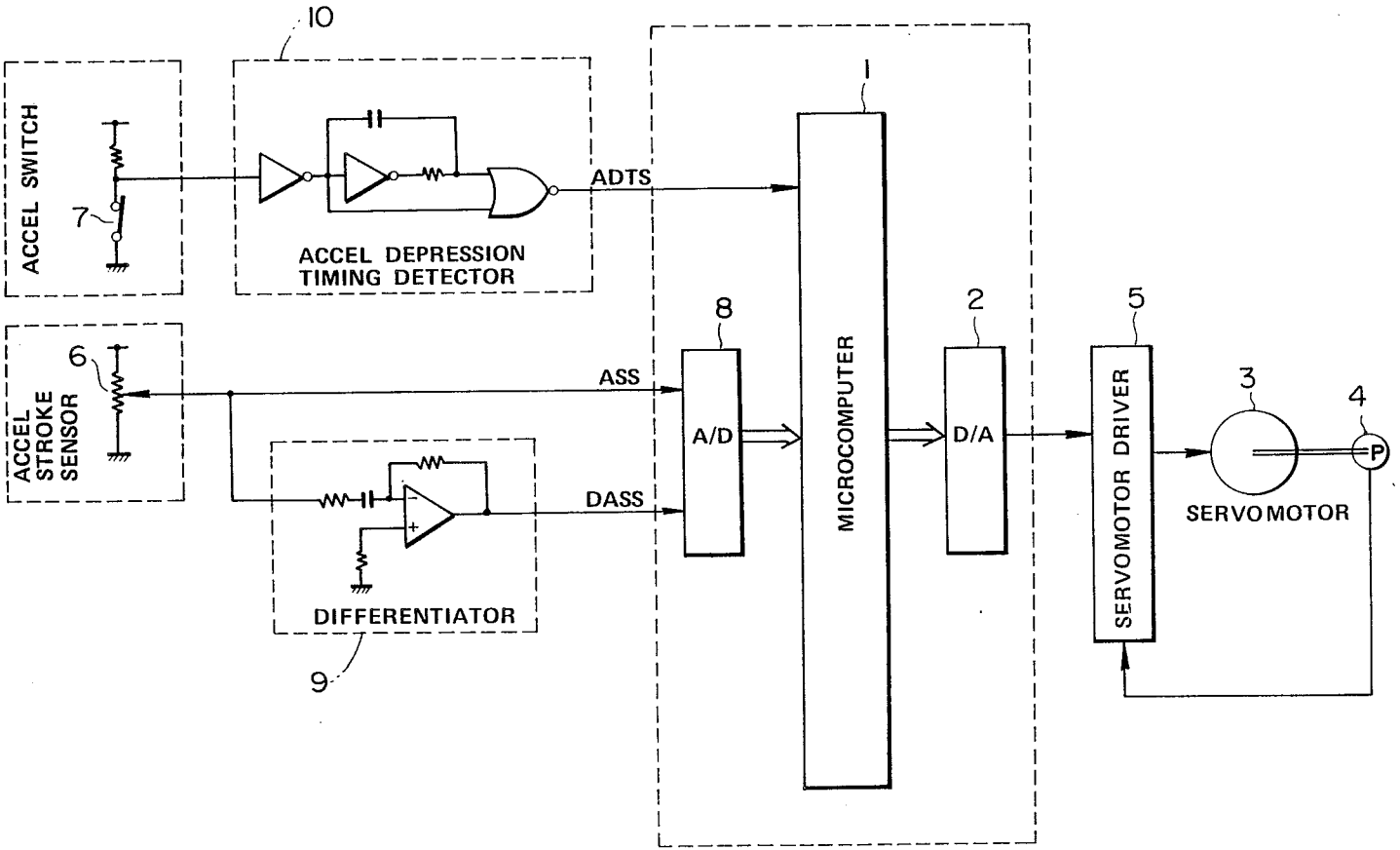
FIG. 1 is a schematic block diagram showing a first embodiment of the accelerator control system according to the present invention.

FIG. 1 shows a hardware configuration of the accelerator control system including a microcomputer 1. The microcomputer 1 outputs a control signal indicative of a target throttle valve opening rate to a throttle valve servo system through a digital-to-analog converter 2. This servo system is made up of a servo motor 3 for opening or closing a throttle valve, a throttle valve position sensor 4 such as a potentiometer for detecting the opening rate of the throttle valve, and a servomotor driver 5 for comparing the control signal indicative of the target throttle valve opening rate outputted from the microcomputer 1 with the output signal indicative of the actual opening rate outputted from the throttle valve position sensor 4 in order to drive the servomotor 3 in the normal or reverse direction so that the actual throttle valve opening rate detected by the position sensor matches the target rate.

On the other hand, on the input side of the microcomputer 1, there are provided an accelerator pedal stroke sensor 6 such as potentiometer for detecting the stroke of an accelerator pedal and an accelerator pedal switch 7 turned on by a spring (not shown) when the accelerator pedal is released to the original (zero-stroke or released) position and turned off when the pedal is depressed by the driver. The accelerator pedal stroke sensor 6 outputs an accelerator pedal stroke signal ASS to the microcomputer 1 through an analog-to-digital converter 8. Additionally, this accelerator pedal stroke signal ASS is differentiated through a differentiator 9 including an operational amplifier into an accelerator pedal stroke displacement speed signal DASS. This accelerator pedal stroke speed signal DASS is also applied to the microcomputer 1 through the analog-to-digital converter 8. The timing when the accelerator pedal switch 7 is turned from on to off, that is, when the accelerator pedal is depressed to accelerate the vehicle, is detected through an accelerator pedal depression timing detector 10. The accelerator pedal depression timing signal (ADTS) detected by this detector 10 is also applied to the microcomputer 1 directly. The accelerator pedal depression timing detector 10 detects the rising edge of the signal from the accelerator pedal switch 7 and outputs a pulse signal with a small pulse width.

On the basis of the above-mentioned accelerator pedal stroke signal ASS, accelerator pedal stroke speed signal DASS and accelerator pedal depression timing signal ADTS, the microcomputer 1 determines target throttle valve opening rates and outputs control signals corresponding thereto to the servomotor driver 5. In more detail, a plurality of target throttle valve opening rates are predetermined and previously stored in the memory unit of the microcomputer 1 with the accelerator pedal stroke as variable in the form of function tables.

Figure 2:
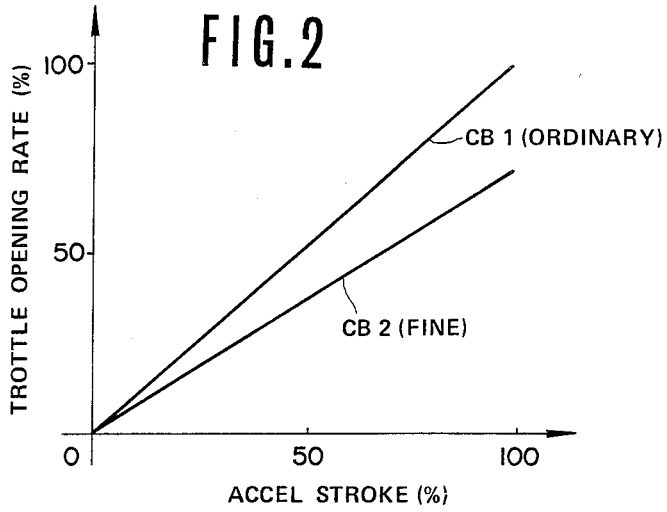
FIG. 2 is a graphical representation showing the ordinary accelerator control characteristics and the fine accelerator control characteristics, both characteristics being indicated as the relationship between accelerator pedal stroke and throttle valve opening rate.

In this embodiment, two kinds of control characteristics CB1 and CB2 representative of the relationship between accelerator pedal stroke and throttle valve opening rate are predetermined, as depicted in FIG. 2. Both the control characteristics CB1 and CB2 are determined to be linear, by way of example, in which throttle valve opening rate increases in proportion to accelerator pedal stroke. The characteristics CB1 are so determined as to be roughly the same as in the conventional accelerator pedal control device in which the accelerator pedal is directly linked to the throttle valve mechanically. Therefore, in the characteristics $CB_1$, throttle valve opening rate increases relatively sharply with increasing accelerator pedal stroke. In such characteristics, the driver can accelerate the vehicle quickly or ordinarily. In contrast with this, the characteristics CB3 are so determined that throttle valve opening rate increases relatively gently with increasing accelerator pedal stroke. In such characteristics, the driver can accelerate the vehicle gently and finely. Hereinafter, the control characteristics CB1 are called ordinary control characteristics; the control characteristics CB2 are called fine control characteristics.

In this embodiment, under ordinary vehicle travelling conditions, the accelerator system is controlled in accordance with the ordinary control characteristics CB1. However, the accelerator system is controlled in accordance with the fine control characteristics CB2 under the following vehicle travelling conditions: (1) the accelerator pedal is depressed beginning from the position where the pedal is returned to the original zero position; (2) the accelerator pedal stroke is below a predetermined reference value within a sufficiently short period To after the accelerator pedal has been depressed; and (3) the accelerator pedal stroke speed is also below a predetermined reference value within the period To. In other words, the accelerator control characteristics are switched from the ordinary characteristics CB1 to the fine characteristics CB2, when the voltage levels of the detected accelerator pedal stroke signal ASS and the detected accelerator pedal stroke speed signal DASS do not both exceed the reference voltage levels ASS1 and DASS1 respectively within the predetermined time period To after the accelerator pedal depression timing detector 10 outputs an accelerator pedal depression timing signal ADTS.

Figure 3:
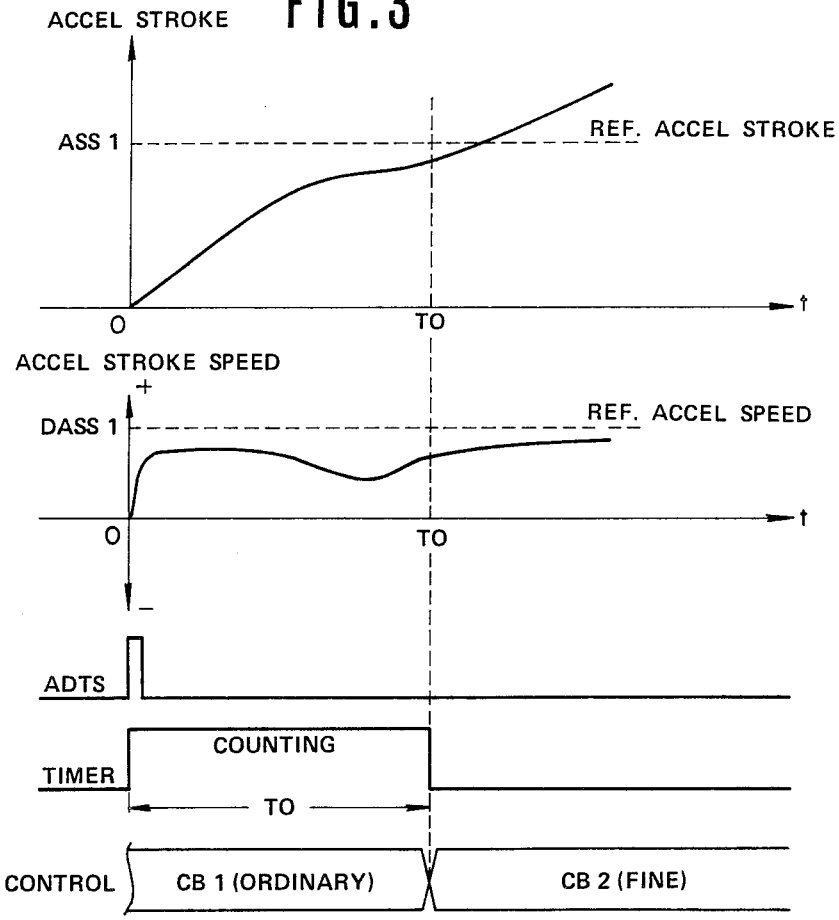
FIG. 3 is a timing chart for assistance in explaining the operation of the first embodiment of the accelerator control system according to the present invention shown in FIG. 1.

The above-mentioned operation will be described in more detail with reference to the timing chart shown in FIG. 3. When the accelerator pedal is depressed below its released position (the position it assumes when it is released), the accelerator pedal depression timing signal ADTS is generated. In response to this signal ADTS, the microcomputer 1 activates a timer function provided therewithin in order to count a predetermined time period To. While this timer function is in operation, the accelerator pedal stroke signals ASS and the accelerator pedal stroke displacement speed signals DASS are both repeatedly sampled and updated. These signals are then compared with the respective reference signals ASS1 and DASS1 in voltage level. If neither of the two updated signals ASS and DASS exceed the reference signals ASS1 and DASS1 respectively and continuously during the counted time period To, the ordinary control characteristics CB1 are changed to the fine control characteristics CB2 immediately after the time To has elapsed. In the case where either or both of the two signals ASS and DASS exceed the reference signals ASS1 and DASS1 respectively within the period To, the accelerator system is controlled in accordance with the ordinary control characteristics CB1.

The above-mentioned two reference values ASS1 and DASS1 are both determined on the basis of various experiments. These experiments have been made when a number of drivers depress the accelerator pedal as they normally would while attempting repeatedly to drive the vehicle only a slight distance forward. The reference accelerator pedal stroke ASS1 is determined to be approximately 20 percent of the position where the pedal is fully depressed; the reference accelerator pedal stroke speed DASS1 is determined to be a speed at which the pedal is fully depressed during approximately one second.

With reference to a flowchart shown in FIG. 4, an exemplary processing procedure of the microcomputer 1 will be described hereinbelow in greater detail. When the control program starts, the system is initialized and the ordinary control characteristics CB1 are first stored in a register (in block 101). Next, control checks whether the accelerator pedal depression timing signal ADTS indicative of the fact that the accelerator pedal is depressed from the fully released position is present or not (in block 110). If ADTS is present, control checks whether a flag FFADTS indicative of the fact that the signal ADTS has already been detected is set or not (in block 111). If FFADTS is not yet set, the flag is set to FFADTS=1 (in block 112) and control starts the timer function for counting a predetermined short time period To (in block 113). Further, if the flag is already set (in block 111), since this indicates that the timer function is in operation, control skips the blocks 112 and 113. While the timer is in operation, accelerator pedal stroke signals ASS and accelerator pedal stroke speed signals DASS are both repeatedly read into the microcomputer (in block 120) and compared with the two reference values ASS1 and DASS1, separately (in block 121). If either or both of the two signals ASS and DASS exceed the reference values ASS1 and DASS1 (in block 121) respectively, the timer function is stopped (in block 124) and then the ordinary control characteristics CB1 are stored in the register (in block) 132). If neither of the two signals ASS and DASS exceeds the reference values ASS1 and DASS1 respectively, control checks whether the time To counted by the timer function has elapsed or not (in block 122). If it has not elapsed, control keeps storing the ordinary control characteristics CB1 in the register until the counted time is up (in block 130). If the counted time has elapsed (in block 122), the timer function is stopped (in block 123) and the ordinary control characteristics CB1 are changed to the fine control characteristics CB2 and stored in the register (in block 131).

Further, in the block 110, when the accelerator pedal depression timing signal ADTS is not detected (in block 110), since this indicates that the control operation has already started, control set the flag FFADTS to "0" and then checks whether the timer function is in operation or not (in block 115). If the timer function is counting the predetermined time period To, the signals ASS and DASS are both read again.

In the above-mentioned control program, either of the control characteristics CB1 or CB2 are always stored in the register in order to control throttle valve opening rates according to the accelerator pedal strokes, and the above operations are executed repeatedly at a high speed.

After appropriate control characteristics CB1 or CB2 have been selected and stored in the register, control reads the accelerator pedal stroke signal ASS (in block 140) and determines an appropriate throttle valve opening rate corresponding to the read stroke signal ASS (in block 141). In this block 141, the appropriate throttle valve opening rate is determined in accordance with well-known table look-up method and interpolation calculations or operations. In the above-mentioned function table, the characteristics CB1 or CB2 are listed on the basis of the relationship between accelerator pedal stroke and throttle valve opening rate as already described with reference to FIG. 2.

Thereafter, a signal indicative of the determined target throttle valve opening rate is outputted (in block 142) to the servomotor driver 5 in order to drive the servomotor 3 so that the actual throttle valve opening rate matches the target opening rate.

Further, in block 115, if the timer is not in operation, since this indicates that the predetermined time period To has elapsed, control skip to block 140 in order to determine the throttle valve opening rate in accordance with the control characteristics CB1 or CB2 previously selected and stored in the register.

With reference to FIGS. 5, 6(A), 6(B), and 7, a second embodiment of the accelerator control system according to the present invention will be described hereinbelow. The difference between the first embodiment shown in FIGS. 1, 2, 3, and 4 and the second embodiment is as follows: In the first embodiment, the control characteristics are changed from the ordinary ones CB1 to the fine ones CB2 only when neither the accelerator pedal stroke signal ASS nor the accelerator pedal stroke speed signal DASS exceeds the respective first reference signals ASS1 or DASS1 in voltage level within a predetermined time period To after the accelerator pedal is first depressed. Further, the changed fine control characteristics CB2 are kept as they are until the accelerator pedal is depressed again. In other words, whenever the accelerator pedal is depressed by the driver, the characteristics are adjusted only once according to the pedal stroke and the pedal stroke speed.

In contrast with this, in the second embodiment, the control characteristics are changed from the ordinary ones CB1 to the fine ones CB2 as in the first embodiment but returned to the ordinary ones CB1 while the pedal is kept depressed, when either or both of the accelerator pedal stroke signal ASS and the accelerator pedal stroke speed signal DASS exceed the respective second reference signals ASS2 and DASS2. This is because when vehicle travelling conditions change, it is preferable to select ordinary characteristics CB1 again on which the vehicle can be accelerated quickly without depressing the accelerator pedal deeply. In other words, while the accelerator pedal is being depressed by the driver, the characteristics are changed from the ordinary ones CB1 to the fine ons CB2 or vice versa according to the pedal stroke and the pedal stroke speed values.

Figure 5:
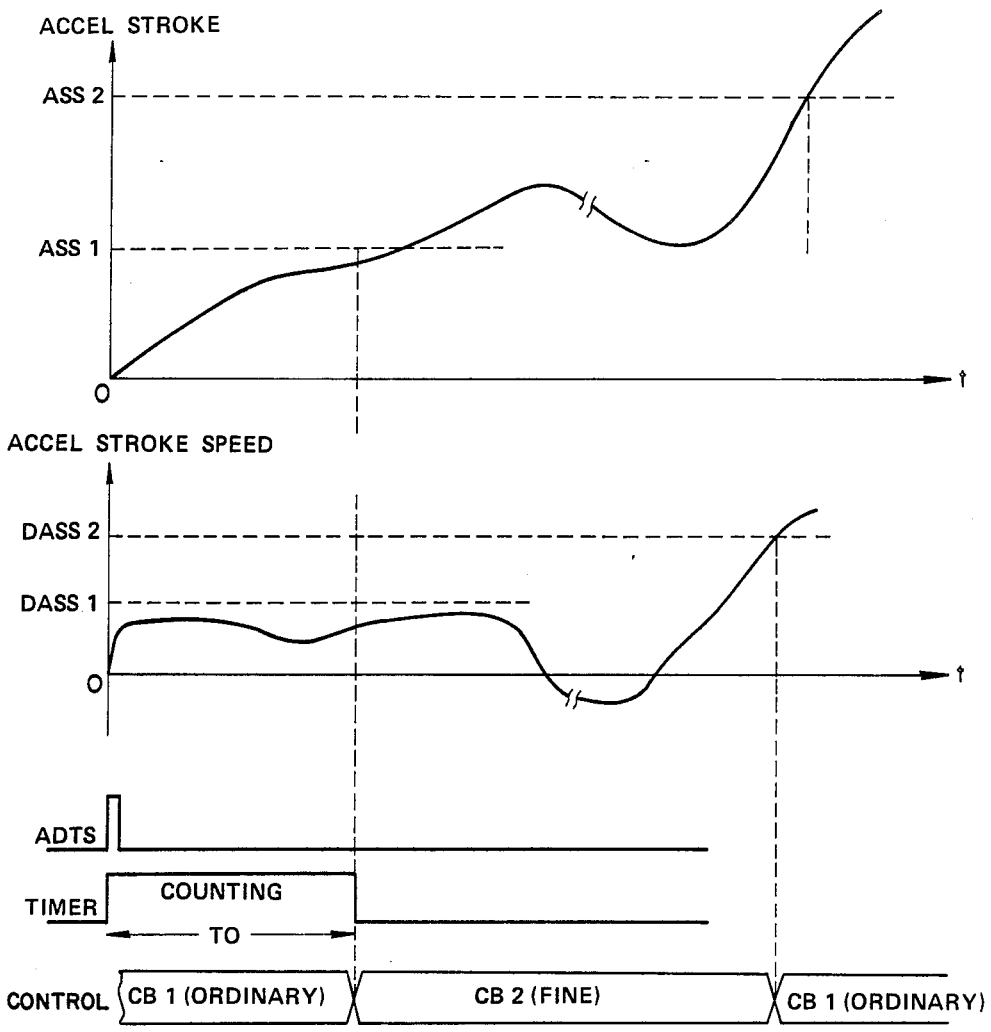
FIG. 5 is a timing chart for assistance in explaining the operations of the second embodiment of the accelerator control system according to the present invention also shown in FIG. 1.

With reference to the timing chart shown in FIG. 5, when the accelerator pedal is depressed from its released position, the accelerator pedal depression timing signal ADTS is generated. In response to this signal ADTS, the microcomputer 1 activates a timer function provided therewithin in order to count a predetermined period To. While this timer function is in operation, the accelerator pedal stroke signal ASS and the accelerator pedal stroke displacement speed signal DASS are repeatedly sampled and updated. These signals are then compared with the reference values thereof ASS1 and DASS1. If the neither of the updated signals ASS and DASS exceeds its respective reference signal ASS1 and DASS1 continuously during the counted time period To, the ordinary characteristics CB1 is changed to the fine characteristics CB2 immediately after the time To has elapsed. In the case where either or both of the two signals ASS and DASS exceed the reference signals ASS1 and DASS1 respectively, the accelerator system is of course controlled in accordance with the ordinary characteristics CB1.

Further, as depicted in FIG. 5, even after the fine characteristics CB2 has been selected, since the accelerator pedal stroke signals ASS and the accelerator pedal stroke displacement speed signals DASS are repeatedly sampled and updatd, these two signals are further compared with other reference signals thereof ASS2 and DASS2. If either or both of the two updated signals ASS and DASS exceed the reference signals ASS2 and DASS2 after the control characteristics has been changed to the fine ones CB2, the fine control characteristics CB2 are returned to the ordinary control characteristics CB1.

Figure 6:
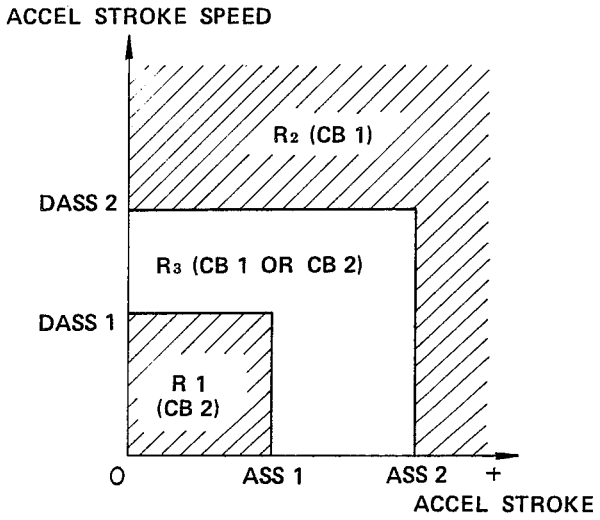
FIG. 6(A) is a representation showing a first range where the fine control characteristics are selected and a second range where the ordinary characteristics are selected in relation to accelerator pedal stroke and accelerator pedal stroke speed, in the second embodiment of the present invention.
FIG. 6(B) is another similar representation in the second embodiment of the present invention.
Figure 6:
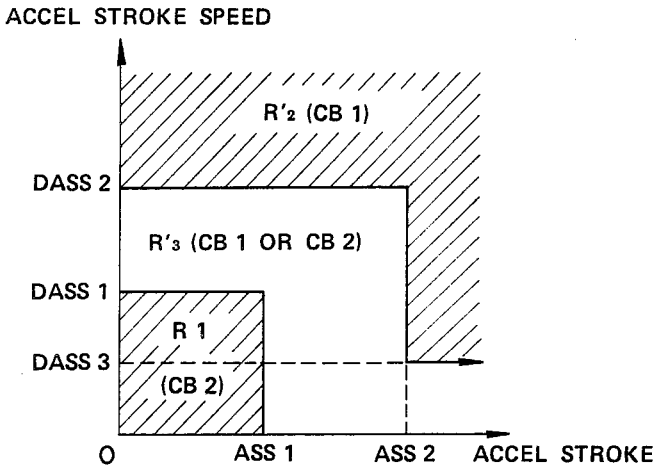

These control characteristic selecting operation will be described with reference to FIG. 6A, in which the accelerator pedal stroke ASS is taken on the abscissa and the accelerator pedal stroke speed DASS is taken on the ordinate. In FIG. 6(A), the label $R_1$ designates a first range where the accelerator pedal stroke signal ASS does not exceed first reference signal ASS1 and the accelerator pedal stroke speed signal DASS does not also exceed the first reference signal DASS1. When these two signals ASS and DASS both do not exceed the reference signals ASS1 and DASS1 respectively in voltage level within the predetermined time period To after the pedal has been depressed, the fine characteristics CB2 are selected. The label $R_2$ designates a second range where the signal ASS exceeds the second reference signal ASS2 or the signal DASS exceeds the second reference signal DASS2 in voltage level. When either or both of the two signal ASS and DASS exceed these two reference signals ASS2 and DASS2 even after the fine characteristics CB2 have been selected, the fine control characteristics CB2 are returned to the ordinary control characteristics CB1. Further, the label $R_3$ designates a third range where the stroke signal ASS lies in voltage level between ASS1 and ASS2 and further below DASS2 or the stroke speed signal DASS lies in voltage level between DASS1 and DASS2 and further below ASS2. Since the ordinary characteristics CB1 are selected when the microcomputer 1 is initialized, as far as the fine characteristics CB2 are not selected within the range $R_1$, the control characteristics CB1 are kept stored as they are in the microcomputer 1. However, once the fine characteristics CB2 have been selected within the range $R_1$, the characteristics CB2 are kept stored as they are in the microcomputer 1 within the third range $R_3$.

Additionally, FIG. 6(B) shows another modification of these control characteristic ranges. In this modified embodiment, even if the accelerator pedal stroke signal ASS exceeds the second reference signal ASS2 in voltage level, when the accelerator pedal stroke speed signal DASS is so small in voltage level as to be below a third reference signal DASS3, the fine characteristics CB2 are kept stored as they are without returning them to the ordinary characteristics CB1.

The above-mentioned various reference values ASS1, ASS2, DASS1, DASS2 and DASS3 are all determined on the basis of various experiments. These experiments have been made when a number of drivers depress the accelerator pedal as they normally would if they were repeatedly trying to drive the vehicle only a slight distance forward. The first reference accelerator pedal stroke ASS1 is determined to be approximately 20 percent of the position where the pedal is fully depressed and the second reference accelerator pedal stroke ASS2 is determined to be approximately 40 percent of the same position. The first reference accelerator pedal stroke speed DASS1 is determined to be a speed at which the pedal is fully depressed during approximately one second; the second reference accelerator pedal stroke speed DASS2 is determined to be a speed at which the pedal is fully depressed during approximately 0.5 seconds; and the third reference accelerator pedal stroke speed DASS3 is determined to be a speed at which the pedal is fully depressed during approximately 2 seconds.

Figure 7:
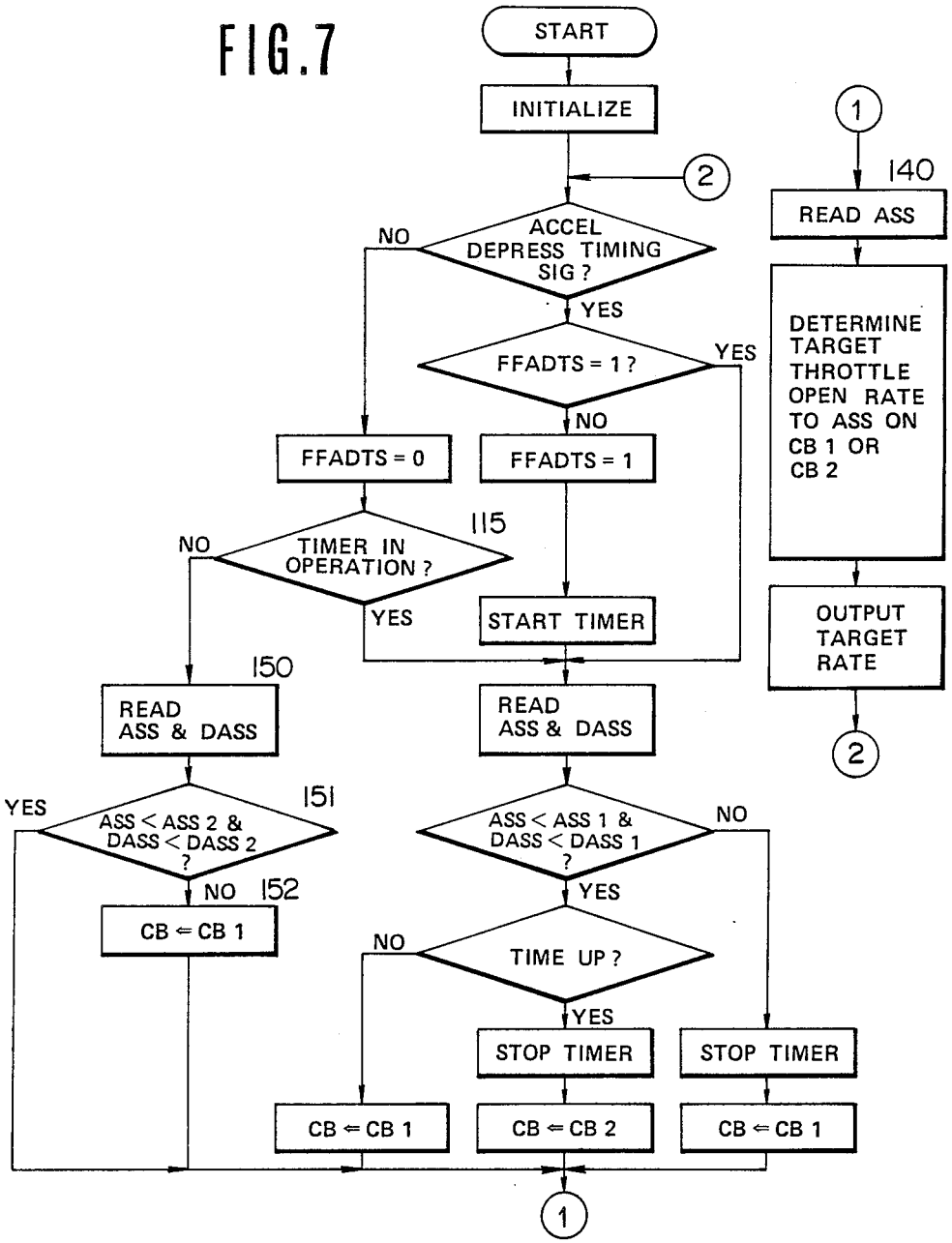
FIG. 7 is a flowchart for assistance in explaining the processing steps or operations of the second embodiment of the accelerator control system according to the present invention also shown in FIG. 1.

With reference to a flowchart shown in FIG. 7, the processing procedure of this second embodiment will be described hereinbelow. When the timer function stops after a predetermined time period To has elapsed (in block 115), control reads both the accelerator pedal stroke signal ASS and the accelerator pedal stroke speed signal DASS (in block 150). Thereafter, the voltage levels of these two read signals ASS and DASS are compared with the voltage levels of the second reference signals ASS2 and DASS2 respectively; that is, control checks whether either or both of these two read signals ASS and DASS exceed the second reference signals ASS2 and DASS2 separately (in block 151). If either or both of these signals ASS and DASS exceed the these second reference signals ASS2 and DASS2 respectively in voltage level, the control characteristics are changed to the ordinary control characteristics CB1 (in block 152). If both of these signals do not exceed the second reference signals (in block 151), the control does not change the control characteristics.

Figure 8:
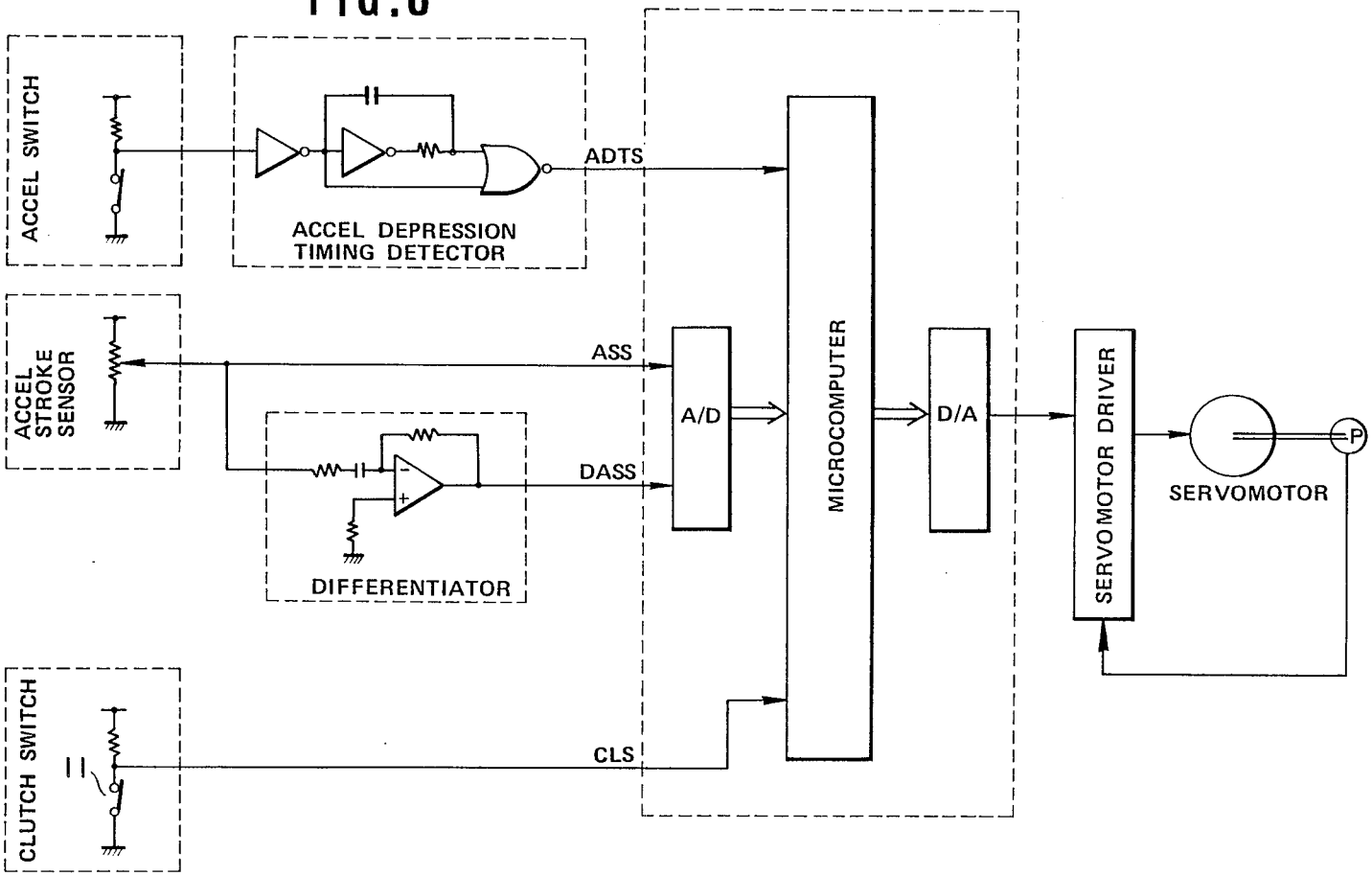
FIG. 8 is a schematic block diagram showing a third embodiment of the accelerator control system according to the present invention.
Figure 9:
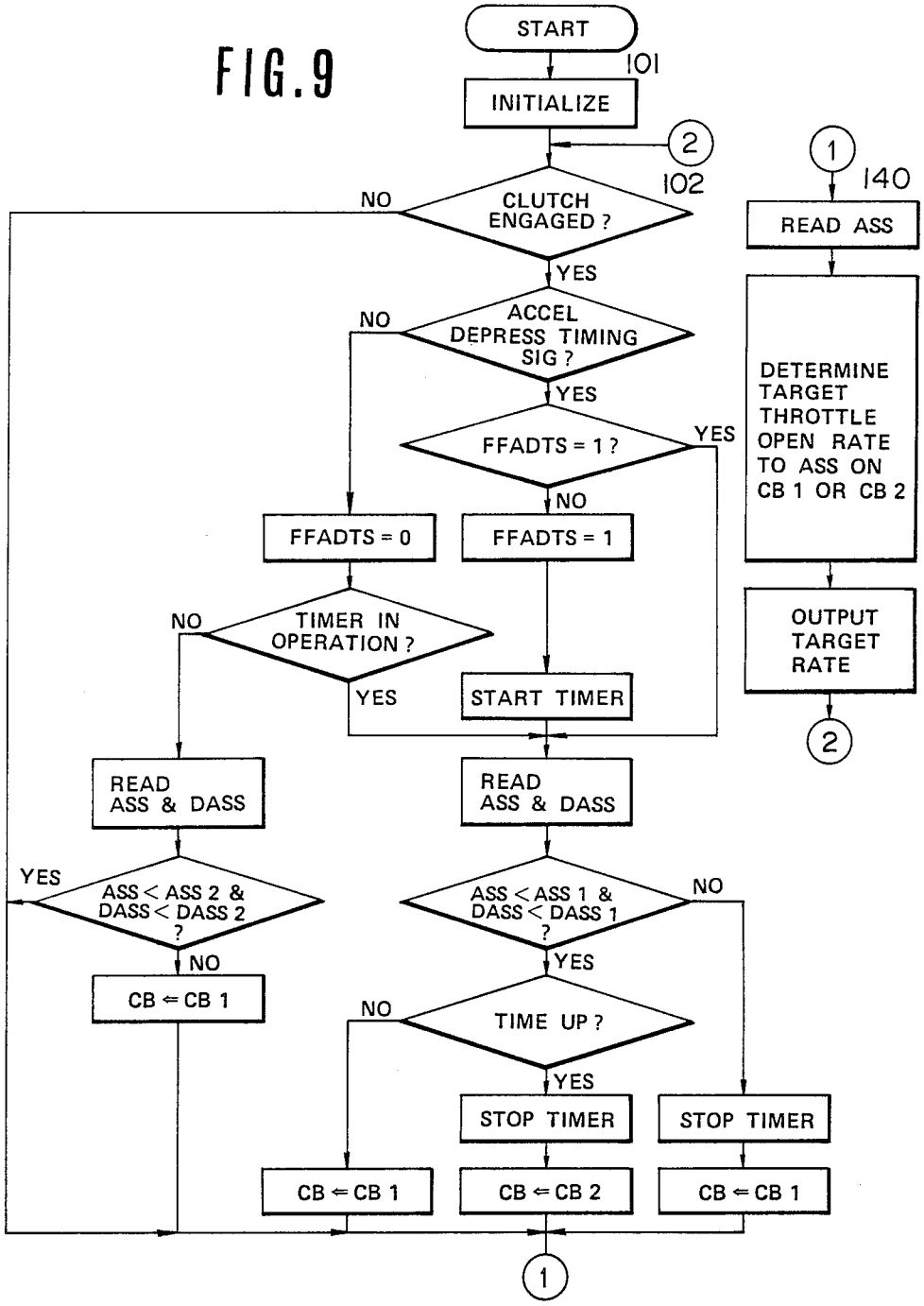
FIG. 9 is a flowchart for assistance in explaining the processing steps or operations of the third embodiment of the accelerator control system according to the present invention in FIG. 8.

With reference to FIGS. 8 and 9, a third embodiment of the accelerator control system according to the present invention will be described hereinbelow. The feature of this third embodiment is to change the control characteristics from the ordinary ones CB1 to the fine ones CB2 under the consideration of the engagement-/disengagement conditions of the clutch. In more detail, in the case where the clutch is disengaged, the control characteristics are not changed, irrespective of the stroke or stroke speed of the accelerator pedal, that is, even when the system determines that the characteristics should be changed to appropriate characteristics CB1 or CB2. In other words, the control procedure to change the characteristics is executed only when the clutch is being engaged.

FIG. 8 shows the system configuration of the third embodiment of the system according to the present invention, in which only a clutch switch 11 is provided in addition to the elements shown in FIG. 1 (the first and second embodiments). This clutch switch 11 is closed when the clutch is being released or engaged but opened when the clutch is being depressed or disengaged. The clutch timing signal CLS is also inputted to the microcomputer 1.

With reference to a flowchart shown in FIG. 9, the procedure of the third embodiment will be described hereinbelow. When control is initialized (in block 101), control first checks whether the clutch switch 11 is on (engaged) or off (disengaged) (in block 102). If the clutch switch 11 is off; that is, the clutch is depressed or disengaged, control advances the steps directly to the step where the accelerator pedal stroke signal ASS is read to determine an appropriate throttle valve opening rate according to the pedal stroke (in block 140) without executing the steps for determining whether the driver depresses the accelerator pedal finely; that is, for selecting the fine control characteristics CB2. If the clutch switch 11 is on; that is, the clutch is released or engaged, control executes the various steps for selecting the fine control characteristics CB2 as already described in the second embodiment.

The above-mentioned third embodiment has an advantage which can settle the following problems: In the state where the clutch is depressed and therefore disengaged, the accelerator pedal is generally fully released or is depressed only a little. Under these conditions, the driver does not necessarily want the fine control characteristics CB2. Therefore, when the fine control characteristics CB2 have been selected with the clutch disengaged, there exist a problem in that it is impossible for the driver to quickly accelerate the vehicle immediately after the clutch has been engaged by the driver.

Figure 10:
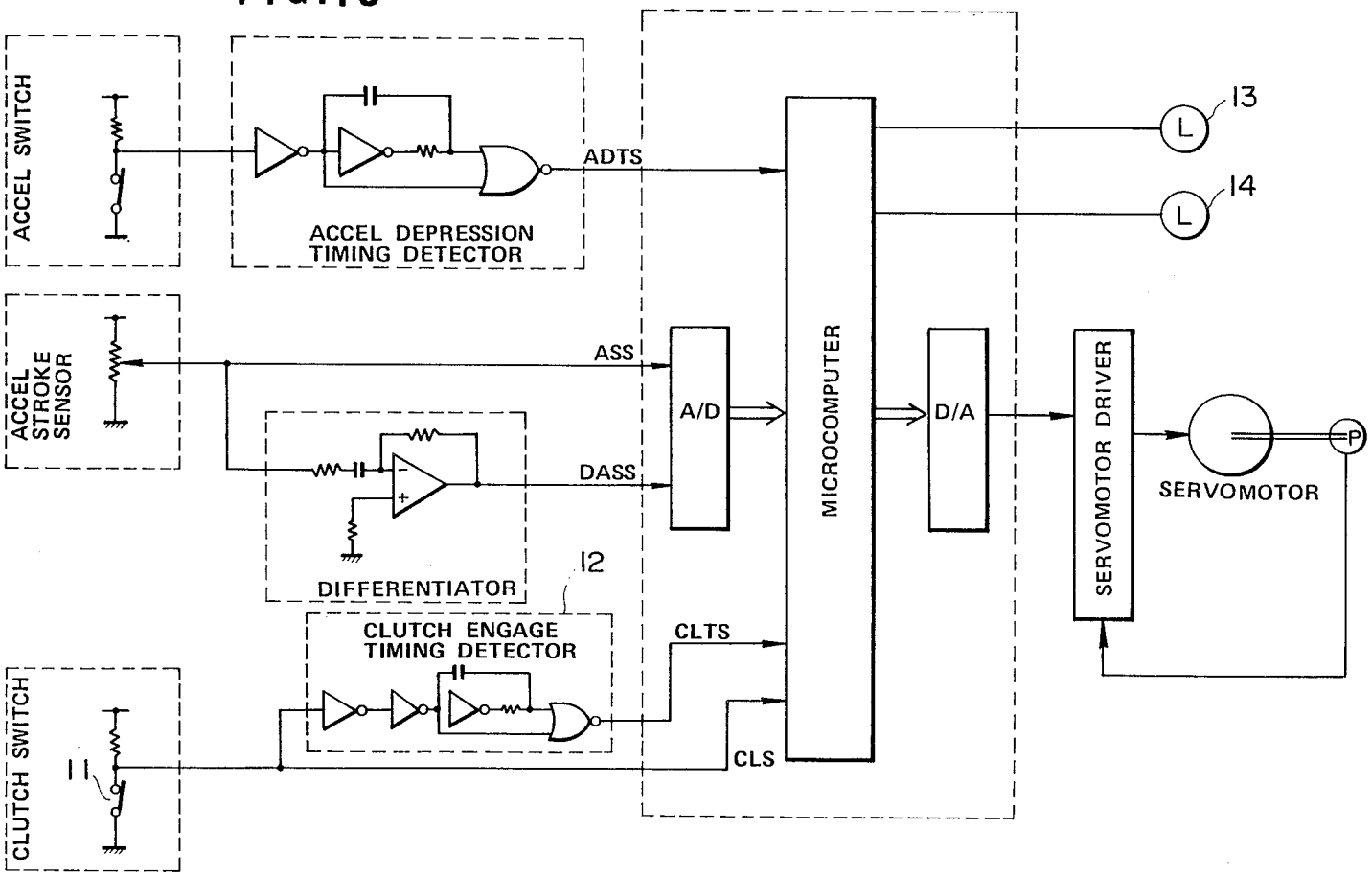
FIG. 10 is a schematic block diagram showing a fourth embodiment of the accelerator control system according to the present invention.
Figure 11:
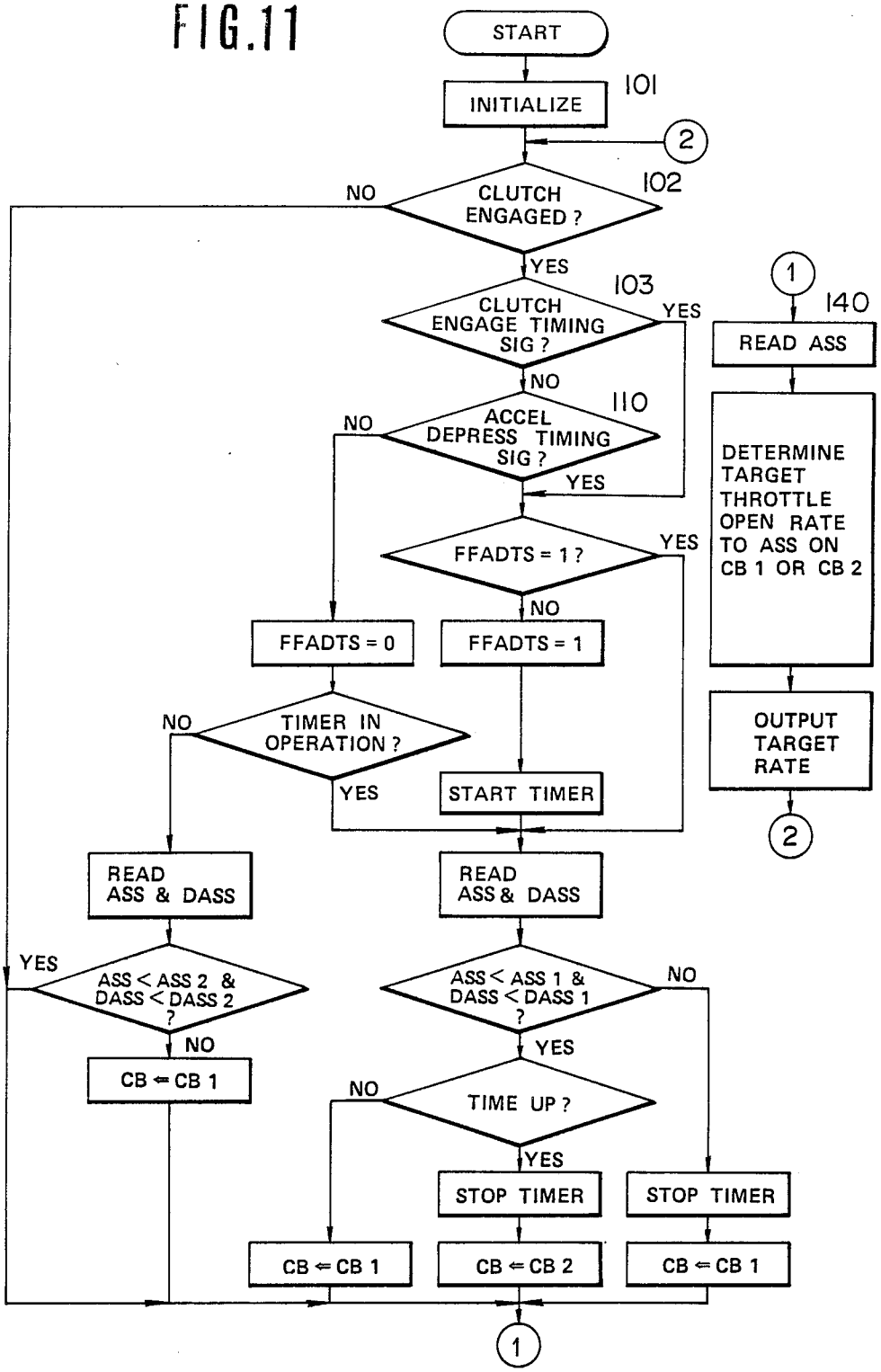
FIG. 11 is a flowchart for assistance in explaining the processing steps or operations of the fourth embodiment of the accelerator control system according to the present invention shown in FIG. 10.

With reference to FIGS. 10 and 11, a fourth embodiment of the accelerator control system according to the present invention will be described hereinbelow. The feature of this fourth embodiment is to change the control characteristics from the ordinary ones CB1 to the fine ones CB2 under the consideration of engagement-/disengagement conditions of the clutch and further clutch engagement timing having priority over accelerator pedal depression timing. In more detail, in the case where the clutch is disengaged, the control characteristics are not changed to the fine control characteristics CB2, irrespective of the stroke and the stroke speed of the accelerator pedal as in the third embodiment. Additionally, in the case where the clutch is once engaged, the control procedure for changing the ordinary control characteristics CB2 to the fine control characteristics CB2 is executed, irrespective of the presence or absence of the accelerator pedal depression timing signal, that is, of whether the accelerator pedal is first depressed or not. In other words, the step for counting the predetermined time period To is executed in response to the clutch engagement timing signal CLS having priority over the accelerator pedal depression timing signal ADTS.

FIG. 10 shows the configuration of the fourth embodiment of the system according to the present invention, in which only a clutch engagement timing detector 12 is provided in addition to the elements shown in FIG. 8 (the third embodiment). This detector 12 is connected to the clutch switch 11 for detecting the timing when the clutch is engaged and outputs a pulse signal CLTS with a short pulse width to the microcomputer 1.

With reference to a flowchart shown in FIG. 11, the processing procedure of the fourth embodiment will be described hereinbelow. When control is initialized (in block 101), control first checks whether the clutch switch 11 is on (engaged) of off (disengaged) (in block 102). If the clutch switch 11 is off, that is, the clutch is depressed or disengaged, control advances the steps directly to the step where the accelerator pedal stroke signal ASS is read (in block 140) without executing the steps for determining whether the driver depreses the accelerator pedal finely. If the clutch switch 11 is on; that is, the clutch is released or engaged, control first checks whether the clutch engagement timing signal CLTT is present or not (in block 103). If present, control skips the step for checking the presence of the accelerator pedal depression timing signal ADTS (block 110), that is, disregards the presence or absence of the accelerator pedal depession timing signal ADTS. Thereafter, control executes the same processing steps for determining whether the characteristics should be changed to the fine ones CB2 or not. Further, when the clutch engagement timing signal ADTS is absent (in block 103), control of course executes the step for determining whether the accelerator pedal depression timing signal ADTS is present or not (in block 110). Therefore, in the case when the accelerator pedal stroke ASS and the accelerator pedal stroke speed DASS do not both exceed the first reference values ASS1 and DASS1 within the predetermined time period To after the clutch has been engaged, the fine characteristics CB2 are selected, in the same way as in the first embodiment.

This embodiment results from the fact that whenever the driver depresses the accelerator pedal finely, the timing when the pedal is depressed is closely related to the timing when the clutch is released. In more detail, when the driver drives the vehicle a little distance forward repeatedly on a busy load, he usually engages the clutch a little, immediately before he depresses the accelerator pedal. Therefore it is possible for the driver to drive the vehicle in accordance with the fine control characteristics, immediately after the accelerator pedal has been depressed.

Further, in this embodiment, whenever the clutch is engaged, the clutch engagement timing signal CLTS is generated. Therefore, it seems that the step (block 103) is redundant. However, since the processing steps shown in FIG. 11 are executed repeatedly, there exist the cases where the clutch engagement timing signal CLTS is not present while the clutch is kept engaged and therefore the timing function should be activated in response to the pedal depression timing signal ADTS (in block 110). In other words, this step (shown in block 103) is redundant at only the first processing cycle but not redundant at and after the second processing cycles.

In FIG. 10, the reference numeral 13 denotes a lamp indicative of the fact that the ordinary control characteristics CB1 is being selected and the reference numeral 14 denotes another lamp indicative of the fact that the fine control characteristics CB2 is being selected. These indicator lamps 13 and 14 are disposed at an appropriate position on the dashboard.

Further, without being limited to these simple lamps 13 and 14, it is also possible to provide various panel displays for indicating selected control characteristics CB1 or CB2.

Figure 12A:
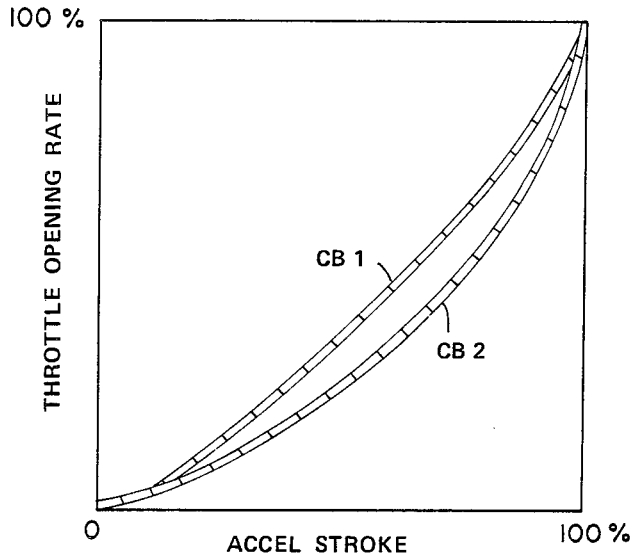
FIG. 12(A) is an illustration showing an example of selected control characteristic displaying means of panel type, in which a plurality of light-emitting elements are incorporated to distinguish the two control characteristics when lighted up.

FIG. 12(A) shows an exemplary display panel in which the selected control characteristic curve is illuminated by a plurality of light-emitting elements such as light-emitting diodes.

Figure 12B:
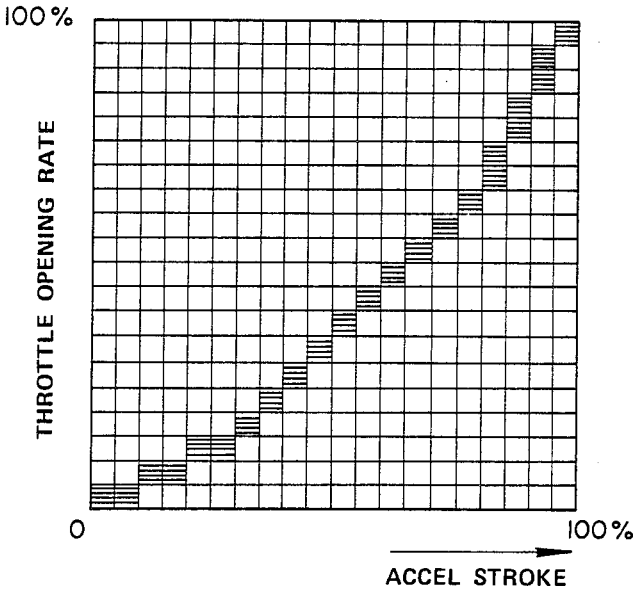
FIG. 12(B) is an illustration showing another example of selected control characteristic displaying means of panel type, in which a dot-matrix display apparatus is incorporated to indicate the selected control characteristics.

FIG. 12(B) shows an exemplary display panel in which the selected control characteristic curve is illuminated by way of a dot matrix display apparatus.

Description has been made hereinabove of the embodiments according to the present invention, in which exemplary elements or processing steps are employed. However, it is also possible to embody the present invention in various different methods. The various other modified embodiments of the present invention will be described hereinbelow.

(1) With respect to the selection of one of two control characteristics CB1 or CB2, the fine control characteristics CB2 are selected when both of the voltage levels of the detected accelerator pedal stroke signal ASS and the detected accelerator pedal stroke speed signal DASS do not exceed the voltage levels of the first reference signals ASS1 and DASS1 simultaneously, in the above embodiments. However, it is possible to attain roughly the same effect by selecting the fine control characteristics CB2 when one of the voltage levels of the signals ASS and DASS does not exceed a corresponding one of the voltage levels of the first reference signals ASS1 and DASS1. Similarly, the fine control characteristics CB2 are returned to the ordinary control characteristics CB1 when either or both of the voltage levels of the detected accelerator pedal stroke signal ASS and the detected accelerator pedal stroke speed signal DASS exceed the voltage levels of the second reference signals ASS2 and DASS2 simultaneously, in the above embodiments. However, it is possible to attain roughly the same effect by returning the fine characteristics to the ordinary characteristics when one of the voltage levels of the signals ASS and DASS exceeds corresponding one of the voltage levels of the second reference signals ASS2 and DASS2.

(2) In the accelerator control system for automatically selecting the fine control characteristics CB2, it is also preferable to provide a manually operated selector switch for allowing the driver to select any desired one of the control characteristics CB1 or CB2 by driver preference.

Figure 4:
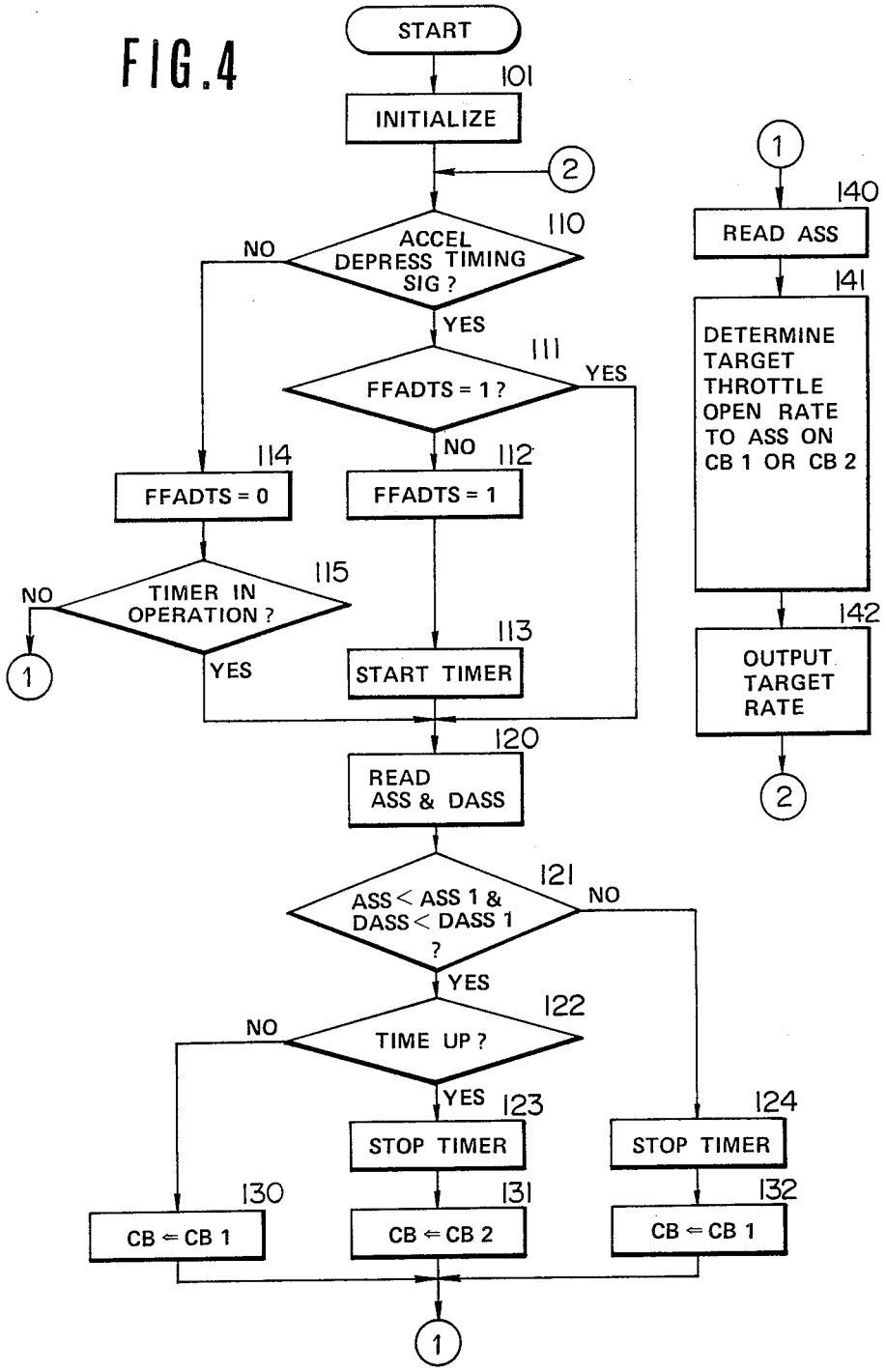
FIG. 4 is a flowchart for assistance in explaining the processing steps or operations of the first embodiment of the accelerator control system according to the present invention shown in FIG. 1.

(3) Further, in FIG. 4, when control determines that the timer function is in operation (in block 122), the control characteristics are set to the ordinary ones CB1 (in block 130). However, it is also possible to provide a manually-operated switch for selecting whether this step (block 130) should be executed or skipped. In the case where the step (block 130) is skipped by depressing this skip switch, the control characteristics previously selected are kept as they are while the timer function is counting the predetermined time period To. In other words, once the driver depresses the accelerator pedal finely, the pedal is controlled in accordance with the fine control characteristics CB2 from the start position where the pedal is fully released.

(4) With respect to the accelerator pedal switch 7, it is possible to attain the same function by utilizing an output signal from the accelerator pedal stroke sensor 6, without additionally providing the accelerator pedal switch 7. In more detail, it is possible to detect the timing that the accelerator pedal is depressed from the fully-released position by comparing the voltage level of the signal generated from the sensor 6 with a predetermined voltage level through an appropriate comparator.

(5) With respect to the accelerator pedal stroke sensor 6, it is of course possible to use various position detecting means such as a rotary encoder, in place of the potentiometer.

(6) With respect to the throttle valve servo driving system, it is of course possible to use various servo systems such as hydraulic or pneumatic system, in place of the servomotor system.

(7) With respect to the control characteristics CB1 or CB2 indicative of the relationship between accelerator pedal stroke and throttle valve opening rate, it is possible to predetermine other quadratic control characteristics under the considerations of or in relation to the throttle valve opening characteristics and the servomotor driving system characteristics, in place of the linear characteristics as shown in FIG. 2. Further, it is also possible to preset three or more accelerator control characteristics and select appropriate characteristics in combination of other engine operating conditions in addition to the accelerator pedal stroke.

(8) With respect to the calculations to determine the target throttle opening rate according to accelerator pedal stroke, it is of course possible to determine the target rate in dependence upon analog circuits including function generators, in place of depending upon table look-up method.

As described above, in the accelerator control system according to the present invention, when the driver once depresses the accelerator pedal finely to drive the vehicle a little distance forward, since the ordinary control characteristics representative of relationship between the throttle valve opening rate and the accelerator pedal stroke are switched automatically to the fine control characteristics suitable to fine accelerator pedal depression, the driver can easily control vehicle speed in driving his vehicle on a busy road, thus preventing the vehicle vibrations caused by the change in engine torque generated when the driver depresses the accelerator pedal irritatingly while the vehicle is travelling at a low speed on a busy road. Additionally, it is also possible to prevent driver's discomfort due to vehicle vibration and driver's irritation due to fatigue caused by the fact that the driver must depress the accelerator pedal finely and repeatedly by his foot. However, in the ordinary vehicle travelling conditions, since the fine control characteristics are returned to the ordinary characteristics automatically, the driver of course can accelerate the vehicle as is usual.

It will be understood by those skilled in the art that the foregoing description is in terms of a preferred embodiment of the present invention wherein various changes and midifications may be made without departing from the spirit and scope of the invention, as set forth in the appended claims.

What is claimed is:

1. An accelerator control system for an automotive vehicle including an accelerator pedal, and a throttle valve, said system comprising:

(a) means for detecting an accelerator pedal depression timing and outputting a signal ADTS corresponding thereto;

(b) means for detecting the stroke of the accelerator pedal and outputting signals ASS corresponding thereto;

(c) means for detecting the speed of the accelerator pedal stroke and outputting signals DASS corresponding thereto;

(d) means for initiating a predetermined time period To in response to the signal ADTS outputting from said accelerator pedal depression timing detecting means;

(e) means for comparing the voltage level of the detected accelerator pedal stroke signal ASS with a first reference stroke voltage level ASS1 and the voltage level of the detected accelerator pedal stroke speed signal DASS with a first reference stroke speed voltage level DASS1 within the predetermined time period To, and outputting a first command signal when either or both of the voltage levels of the detected signals ASS and DASS exceed the first reference voltage levels ASS1 and DASS1 respectively and otherwise outputting a second command signal;

(f) means for storing first ordinary control characteristics such that an opening rate of the throttle valve increases relatively sharply with increasing accelerator pedal stroke and second fine control characteristics such that an opening rate of the throttle valve increases relatively gently with increasing accelerator pedal stroke;

(g) means for selecting selected control characteristics corresponding to the first ordinary control characteristics in response to the first command signal and corresponding to the second fine control characteristics in response to the second command signal;

(h) means for determining target throttle valve opening rates corresponding to the detected accelerator pedal strokes in accordance with the selected control characteristics and outputting target throttle valve opening rate control signals corresponding thereto; and (i) means responsive to said target throttle valve opening rate control signals for opening the throttle valve at the target throttle valve opening rate.

2. An accelerator control system for an automotive vehicle as set forth in claim 1, which further comprises means for comparing the voltage level of the detected accelerator pedal stroke signal ASS with a second reference stroke voltage level ASS2 and the voltage level of the detected accelerator pedal stroke speed signal DASS with a second reference stroke speed voltage level DASS2 after the predetermined time period To has elapsed and outputting a third command signal when either or both of the voltage levels of the detected signals ASS and DASS exceed the second reference voltge levels ASS2 and DASS2 respectively, said control characteristics selecting means selecting the first ordinary control characteristics again in response to the third command signal after the predetermined time period To.

3. An accelerator control system for an automotive vehicle as set forth in claim 2, which further comprises means fo comparing the voltage level of the detected accelerator pedal stroke speed signal DASS with a third reference stroke speed voltage level DASS3 which is lower than the second reference stroke speed voltage level DASS2 after the predetermined time period To has elapsed and prohibiting the third command signal from being outputted when the voltage level of the detected accelerator pedal stroke speed signal DASS is below the third reference stroke speed voltage level DASS3.

4. An accelerator control system for an automotive vehicle as set forth in claim 1, which further comprises means for detecting a state where a clutch is disengaged and outputting signals CLS corresponding thereto, said control characteristc selecting means compulsorily selecting the first ordinary control characteristics in response to the signal CLS.

5. An accelerator control system for an automotive vehicle as set forth in claim 4, which further comprises means for detecting a clutch engagement timing and outputting a signal CLTS corresponding thereto, said predetermined time period measuring means being activated in response to the signal CLTS with priority over the signal ADTS indicative of accelerator pedal depression timing.

6. An accelerator control system for an automotive vehicle as set forth in claim 1, wherein said accelerator pedal depression timing detecting means comprises:

(a) an accelerator pedal switch turned on when the pedal is released to output a Low-voltage level signal and turned off when the pedal is depressed to output a High-voltage level signal; and (b) an accelerator depression timing detector responsive to said switch for outputting a pulse signal ADTS with a short pulse width in response to the High-voltage level signal generated when the pedal is depressed.

7. An accelerator control system for an automotive vehicle as set forth in claim 1, wherein said accelerator pedal stroke detecting means is a potentiometer for outputting a signal the voltage level of which is substantially proportional to the stroke of the accelerator pedal.

8. An accelerator control system for an automotive vehicle as set forth in claim 1, wherein said accelerator pedal stroke speed detecting means is a differentiator responsive to said accelerator pedal stroke detecting means for outputting signals DASS indicative of the stroke speed of the accelerator pedal.

9. An accelerator control system for an automotive vehicle as set forth in claim 1, wherein said predetermined time period measuring means, said detected signal comparing means, said control characteristic storing means, said control characteristic selecting means, and said target throttle valve opening rate determining means are all incorporated within a microcomputer, various operations, calculations or processings being all executed in accordance with appropriate software.

10. An accelerator control system for an automotive vehicle as set forth in claim 1, wherein said throttle valve opening rate controlling means comprises:

(a) a servomotor mechanically connected to the throttle valve for actuating the throttle valve according to a feedback control method;

(b) a position sensor mechanically connected to the throttle valve for detecting the positions thereof representative of throttle valve opening rates; and (c) a servomotor driver responsive to said target throttle valve opening rate determining means and said position sensor for driving said servomotor in the normal or reverse direction according to the feedback control method so that the actual throttle valve opening rate detected by said position sensor matches the target rate.

11. An accelerator control system for an automotive vehicle as set forth in claim 1, which further comprises means for displaying the accelerator control characteristics selected by said control characteristic selecting means.

12. An accelerator control system for an automotive vehicle as set forth in claim 11, wherein said control characteristic displaying means comprises a plurality of lamps operated to indicate selected control characteristics.

13. An accelerator control system for an automotive vehicle as set forth in claim 11, wherein said control characteristic displaying means is a display panel provided with a plurality of light-emitting elements for depicting selected control characteristics optically.

14. An accelerator control system for an automotive vehicle as set forth in claim 11, wherein said control characteristic displaying means is a display panel provided with dot matrix apparatus for depicting selected control characteristics optically.

15. An accelerator control system for an automotive vehicle including an accelerator pedal, and a throttle valve, said system comprising:

(a) means for detecting an accelerator pedal depression timing and outputting a signal ADTS corresponding thereto;

(b) means for detecting the stroke of the accelerator pedal and outputting signals ASS corresponding thereto;

(c) means for detecting the speed of the accelerator pedal stroke and outputting signals DASS corresponding thereto;

(d) microcomputer means for initiating running of a predetermined time period To in response to the signal ADTS outputted from said accelerating pedal depression timing detecting means, comparing the voltage level of the detected accelerator pedal stroke signal ASS with a first reference stroke voltge level ASS1 and the voltage level of the detected accelerator pedal stroke speed signal DASS with a first reference stroke speed voltage level DASS1 within the predetermined time period To, and outputting a first command signal when either or both of the voltage levels of the detected signals Ass and DASS exceed the first reference voltage levels ASS1 and DASS1 respectively and otherwise a second command signal, storing first ordinary control characteristics such that opening rate of the throttle valve increases relatively sharply with increasing accelerator pedal stroke and second fine control characteristics such that opening rate of the throttle valve increases relatively gently with increasing accelerator pedal stroke, for selecting the first ordinary control characteristics in response to the first command signal and otherwise the second fine control characteristics in response to the second command signal, and determining target throttle valve opening rates corresponding to the detected accelerator pedal strokes in accordance with the selected control characteristics and outputting target throttle valve opening rate control signals corresponding thereto; and (e) means responsive to the target throttle valve opening rate control signals for controlling the opening rate of the throttle valve to match the target rate.

16. An accelerator control system for an automotive vehicle as set forth in claim 15, wherein said microcomputer further comprises the functions of comparing the voltage level of the detected accelerator pedal stroke signal ASS with a second reference stroke voltage level ASS2 and the voltage level of the detected accelerator pedal stroke speed signal DASS with a second reference stroke speed voltage level DASS2 after the predetermined time period To has elapsed and outputting a third command signal when either or both of the voltage levels of the detected signals ASS and DASS exceed the two second reference voltage levels ASS2 and DASS2 respectively, said microcomputer selecting the first ordinary control characteristics again in response to the third command signal after the predetermined time period To.

17. An accelerator control system for an automotive vehicle as set forth in claim 15, which further comprises means for detecting the state where the clutch is disengaged and outputting signals CLS corresponding thereto, said microcomputer compulsorily selecting the first ordinary control characteristics in response to the signal CLS.

18. An accelerator control system for an automotive vehicle as set forth in claim 17, which further comprises means for detecting a clutch engagement timing and outputting a signal CLTS corresponding thereto, said microcomputer being activated for initiating the predetermined time period To in response to the signal CLTS with priority over the signal ADTS indicative of accelerator pedal depression timing.

19. An accelerator control system for an automotive vehicle as set forth in claim 15, which further comprises means for displaying the accelerator control characteristics selected by said microcomputer.

20. A method of controlling an accelerator for an automotive vehicle, which comprises the following steps for:

(a) detecting an accelerator pedal depression timing;

(b) measuring a predetermined time period To in response the signal ADTS indicative of accelerator pedal depression timing;

(c) detecting accelerator pedal strokes;

(d) detecting accelerator pedal stroke speed;

(e) storing first ordinary control characteristics such that opening rate of the throttle valve increases relatively sharply with increasing accelerator pedal stroke and second fine control characteristics such that opening rate of the throttle valve increases relatively gently with increasing accelerator pedal stroke;

(f) comparing the detected accelerator pedal stroke ASS with a first reference stroke ASS1 and the detected accelerator pedal stroke speed DASS with a first reference stroke speed DASS1 only within the predetermined time period To;

(g) when either or both of the detected stroke ASS and stroke speed DASS exceed the first reference values ASS1 and DASS1 respectively, stopping the time measuring operation and selecting the first ordinary control characteristics;

(h) when neither the detected stroke ASS nor stroke speed DASS exceeds the first reference values ASS1 and DASS1 respectively, checking whether the predetermined time period To has elapsed or not;

(i) when the time period To has elapsed, stopping the time measuring opertion and selecting the second fine control characteristics;

(j) when the time period To has not elapsed, selecting the first ordinary control characteristics;

(k) determining target throttle valve opening rates corresponding to the detected accelerator pedal strokes in accordance with the selected control characteristics; and (l) controlling the opening rate of the throttle valve to match the target throttle valve opening rate.

21. A method of controlling an accelerator for an automotie vehicle as set forth in claim 20, wherein said first reference stroke ASS1 is approximately 20 percent of the stroke where the pedal is fully depressed and said first reference stroke speed DASS1 is a speed at which the pedal is fully depressed during approximately one second.

22. A method of controlling an accelerator for an automotive vehicle as set forth in claim 20, which further comprises the step of displaying the selected control characteristics.

23. A method of controlling an accelerator for an automotive vehicle as set forth in claim 20, which further comprises the following steps of:

(a) detecting the state where a clutch is engaged or disengaged; and (b) when the clutch is disengaged selecting the first ordinary control characteristics directly without executing any other steps of selecting the fine control characteristics.

24. A method of controlling an accelerator for an automotive vehicle as set forth in claim 23, which further comprises the steps of:

(a) detecting a timing that the clutch is engaged; and (b) measuring the predetermined time period To when the clutch is engaged, skipping the step of detecting the accelerator pedal depression timing.

25. A method of controlling an accelerator for an automotive vehicle as set forth in claim 20, which further comprises the following steps of:

(a) comparing the detected accelerator pedal stroke ASS with a second reference stroke ASS2 and the detected accelerator pedal stroke speed DASS with a second reference stroke speed DASS2 after the predetermined time period To has elapsed; and (b) when either or both of the detected stroke ASS and stroke speed DASS exceed the second referenc values ASS2 and DASS2 respectively, selecting the first ordinary control characteristics.

26. A method of controlling an accelerator for an automotive vehicle as set forth in claim 25, wherein said second reference stroke ASS2 is 40 percent of the stroke where the pedal is fully depressed and said second reference stroke speed DASS2 is a speed at which the pedal is fully depressed during approximately 0.5 seconds.

27. A method of controlling an accelerator for an automotive vehicle as set forth in claim 25, which further comprises the steps of:

(a) comparing the voltage level of the detected accelerator pedal stroke speed signal DASS with a third reference stroke speed voltge level DASS3 which is lower than the second reference stroke speed voltage level DASS2 after the predetermined time period To has elapsed; and (b) prohibiting the third command signal from being outputted when the voltage level of the detected accelerator pedal stroke speed signal DASS is below the third reference stroke speed voltage level DASS3.

28. A method of controlling an accelerator for an automotive vehicle as set forth in claim 27, wherein said third reference stroke speed DASS3 is a speed at which the pedal is fully depressed during approximately two seconds.

* * * * *